US007849651B2

(12) United States Patent
Fujito et al.

(10) Patent No.: US 7,849,651 B2
(45) Date of Patent: Dec. 14, 2010

(54) WALL MATERIALS BRACKET AND INSULATING WALL STRUCTURE

(75) Inventors: Masami Fujito, Osaka (JP); Norio Tsuda, Osaka (JP)

(73) Assignee: Kubota Matsushitadenko Exterior Works, Ltd., Osaka (JP)

( * ) Notice: Subject to any disclaimer, the term of this patent is extended or adjusted under 35 U.S.C. 154(b) by 620 days.

(21) Appl. No.: 11/407,911

(22) Filed: Apr. 21, 2006

(65) Prior Publication Data

US 2006/0265988 A1 Nov. 30, 2006

(30) Foreign Application Priority Data

May 31, 2005 (JP) ..... 2005-160290
May 31, 2005 (JP) ..... 2005-160291
Jun. 30, 2005 (JP) ..... 2005-192749
Jun. 30, 2005 (JP) ..... 2005-192750
Jun. 30, 2005 (JP) ..... 2005-192751
Jun. 30, 2005 (JP) ..... 2005-192752
Jun. 30, 2005 (JP) ..... 2005-192753

(51) Int. Cl.
*E04B 2/00* (2006.01)
*E04G 5/06* (2006.01)

(52) U.S. Cl. ..... 52/506.06; 52/235; 248/216.1

(58) Field of Classification Search ..... 52/235, 52/506.08, 506.09, 506.01, 506.06, 506.1, 52/508; 248/216.1, 216.4, 300, 200
See application file for complete search history.

(56) References Cited

U.S. PATENT DOCUMENTS 1,937,843 A * 12/1933 Clifton ..... 52/407.4
1,997,092 A * 4/1935 Duffy ..... 52/774
1,997,581 A * 4/1935 Heeren et al. ..... 52/506.09
1,997,595 A * 4/1935 Nold et al. ..... 52/506.09
1,997,605 A * 4/1935 Strom et al. ..... 52/145
2,132,547 A * 10/1938 Sohn ..... 52/506.08
2,245,785 A * 6/1941 Jentzer, Jr. ..... 52/416
2,292,984 A * 8/1942 Alvarez, Jr. ..... 52/471
2,866,233 A * 12/1958 Lydard ..... 403/387
3,271,918 A * 9/1966 Phillips ..... 52/506.09
4,307,551 A * 12/1981 Crandell ..... 52/235
4,475,325 A * 10/1984 Veldhoen ..... 52/235
4,483,122 A * 11/1984 Crandell ..... 52/747.1
4,920,719 A * 5/1990 Shaub et al. ..... 52/506.08
5,444,945 A * 8/1995 Goodwin ..... 52/65
5,544,461 A * 8/1996 Sommerstein ..... 52/235
5,644,885 A * 7/1997 Eischeid ..... 52/513

(Continued)

FOREIGN PATENT DOCUMENTS

FR 2503802 10/1982

(Continued)

*Primary Examiner*—Robert J Canfield
*Assistant Examiner*—Brent W Herring
(74) *Attorney, Agent, or Firm*—Greenblum & Bernstein, P.L.C.

(57) ABSTRACT

A wall materials bracket comprises a base piece 11, a catching piece 12, a spacing piece 13 and a holding piece 14, and further includes a leaning means for leaning an insulation put on the catching piece 12 against a wall substrate. For example, the leaning means is constructed with the upper half 111 of the upper part 110 of the base piece 11, a slope 113 in the lower half 112 of the upper part 110, and a cavity 132 and bosses (133) in the upper part 130 of the spacing piece 13.

14 Claims, 13 Drawing Sheets

U.S. PATENT DOCUMENTS

| | | | | | |
|---|---|---|---|---|---|
| 5,673,529 | A | * | 10/1997 | Treister et al. | 52/511 |
| 5,687,524 | A | * | 11/1997 | Ting | 52/461 |
| 5,809,729 | A | * | 9/1998 | Mitchell | 52/474 |
| 5,860,257 | A | * | 1/1999 | Gerhaher et al. | 52/235 |
| 5,941,040 | A | * | 8/1999 | McAnallen et al. | 52/586.1 |
| 6,029,418 | A | * | 2/2000 | Wright | 52/745.1 |
| 6,055,787 | A | * | 5/2000 | Gerhaher et al. | 52/546 |
| 6,098,364 | A | * | 8/2000 | Liu | 52/506.08 |
| 6,170,214 | B1 | | 1/2001 | Treister et al. | |
| 6,205,731 | B1 | * | 3/2001 | Gerhaher | 52/506.01 |
| 6,289,646 | B1 | * | 9/2001 | Watanabe | 52/506.01 |
| 7,043,884 | B2 | * | 5/2006 | Moreno | 52/235 |
| 2001/0011443 | A1 | * | 8/2001 | Watanabe et al. | 52/506.05 |
| 2008/0010922 | A1 | * | 1/2008 | Wagner | 52/235 |

FOREIGN PATENT DOCUMENTS

| | | | | |
|---|---|---|---|---|
| JP | 56-161010 | | | 12/1981 |
| JP | 3-061036 | | | 6/1991 |
| JP | 04360948 | A | * | 12/1992 |
| JP | 05065752 | A | * | 3/1993 |
| JP | 06158814 | A | * | 6/1994 |
| JP | 10-183802 | | | 7/1998 |
| JP | 10-317533 | | | 12/1998 |
| JP | 11-022046 | | | 1/1999 |
| JP | 11-117411 | | | 4/1999 |
| JP | 2000-234432 | | | 8/2000 |
| JP | 2001-193256 | | | 7/2001 |
| JP | 2001-355296 | | | 12/2001 |
| JP | 2002-013272 | A | * | 1/2002 |
| JP | 2003-074132 | | | 3/2003 |
| JP | 2003-74132 | | | 3/2003 |
| JP | 2003-074132 | A | * | 3/2003 |
| JP | 3616931 | | | 11/2004 |
| JP | 2005-068791 | | | 3/2005 |

* cited by examiner

WALL MATERIALS BRACKET AND INSULATING WALL STRUCTURE

TECHNICAL FIELD

The invention relates to wall materials brackets and more particularly a wall materials bracket for fixing an insulation and an external wall board as wall materials on a wall substrate, as well as an insulating wall structure using the wall materials bracket(s).

BACKGROUND ART

Such brackets are used to fix new insulations and external wall boards on a wall substrate such as, for example, an existing wall in remodeling or the like.

A prior art bracket described in Japanese Laid-open Patent Publication No. P2003-74132A comprises a flat plate-shaped base piece (substrate), a flat plate-shaped catching piece (supporting plate), a spacing piece (e.g., two locking pieces) and a holding piece (locking piece). The base piece is fixed on the outer surface of a wall substrate. The catching piece is formed to protrude outward from between the upper and lower parts of the base piece, and holds the bottom end of an upper insulation and the top end of a lower insulation to restrict downward movement of the upper insulation and upward movement of the lower insulation. The spacing piece is formed at the tip of the catching piece so as to face the upper and lower parts of the base piece, and sandwiches the upper and lower two insulations between the base piece and the spacing piece. The spacing piece is also interposed between the upper and lower two insulations and upper and lower two external wall boards to form an air layer between them. The holding piece is formed outside of the spacing piece, and holds the upper and lower two external wall boards to restrict their outward and inward movement as well as downward movement of the upper external wall board and upward movement of the lower external wall board.

However, in the prior art bracket, after the upper insulation is put on the catching piece, it is necessary to support the insulation with hand, adhesive, adhesive tape or the like so as to prevent the insulation from falling outward and then to fix the upper part of the insulation (together with an external wall board in front of it) on the wall substrate with another bracket or the like. As a result, work of fixing the wall materials becomes hard.

DISCLOSURE OF THE INVENTION

It is therefore an object of the present invention to make it possible to free workers from supporting an insulation put on a catching piece and to make work of fixing wall materials easy.

A bracket of the present invention is a wall materials bracket for fixing an insulation and an external wall board as wall materials on a wall substrate, and comprises a flat-shaped base piece, a flat-shaped catching piece, a spacing piece and a holding piece. The base piece is fixed on the outer surface of said wall substrate. The catching piece is formed to protrude outward from between the upper and lower parts of said base piece, and holds the bottom or top end of at least one insulation to restrict its downward or upward movement. The spacing piece is interposed between said at least one insulation and at least one external wall board to form an air layer between them. The spacing piece is formed at the tip of said catching piece so as to face the upper and lower parts of said base piece, and sandwiches said at least one insulation between the base piece and the spacing piece. The holding piece is formed outside of said spacing piece, and holds said at least one external wall board to restrict its outward and inward movement as well as its downward or upward movement. In addition, the wall materials bracket includes a leaning means for leaning the insulation put on said catching piece against said wall substrate.

In one aspect of the present invention, the holding piece is formed outside of said spacing piece and below said catching piece.

In another aspect of the present invention, a butt edge is formed at right or left side end of the wall materials bracket as seen from said holding piece side, and the butt edge inclines at an angle corresponding to a reentrant corner of said wall substrate. An insulating wall structure can be constructed by fixing the wall materials on the wall substrate with the wall materials bracket. The insulating wall structure comprises: at least two said wall materials brackets that are respectively fixed on the two outer surfaces forming the reentrant corner of said wall substrate with their butt edges butted together; at least two said insulations that are butted together and held with the catching pieces of said wall materials brackets; at least two said external wall boards that are held with the holding pieces of said wall materials brackets; and airtight tape that seals between said insulations butted together.

In another aspect of the present invention, a butt edge is formed at right or left side end of the wall materials bracket as seen from said holding piece side, and the butt edge inclines at an angle corresponding to a salient corner of said wall substrate. An insulating wall structure can be constructed by fixing the wall materials on the wall substrate with the wall materials bracket. The insulating wall structure comprises: at least two said wall materials brackets that are respectively fixed on the two outer surfaces forming the salient corner of said wall substrate with their butt edges butted together; at least two said insulations that are butted together and held with the catching pieces of said wall materials brackets; at least one said external wall board that is held with the holding pieces of said wall materials brackets; and airtight tape that seals between said insulations butted together.

An insulating wall structure can be constructed by fixing the wall materials on the wall substrate with the wall materials bracket. The insulating wall structure comprises: said wall materials brackets that are fixed and arranged in at least one row on the outer surface of said wall substrate; said insulations that are fixed and arranged side by side with said wall materials brackets; said external wall boards that are fixed and arranged side by side with said wall materials brackets; airtight tape that seals between said insulations neighboring each other; and waterproof materials that waterproofs between said external wall boards neighboring each other. In addition, the insulation has a width substantially equal to one or more times width of the external wall board.

An insulating wall structure can be constructed by fixing the wall materials on the wall substrate with the wall materials bracket. The insulating wall structure includes at least two said insulations butted together, and one of them has a transformable tongue which is pressed against a butt end of another of them.

An insulating wall structure can be constructed by fixing the wall materials on the wall substrate with the wall materials bracket. The insulating wall structure comprises: at least one said insulation; at least one said wall materials bracket that is fixed on the outer surface of said wall substrate and holds said insulation with the holding piece to form an air layer between them; and at least one said external wall board that is held with the holding piece of said wall materials bracket. The air layer between said wall substrate and said insulation is sealed to function as an airtight layer, while the air layer between said insulation and said external wall board is connected to the open air to function as a vent layer.

BRIEF DESCRIPTION OF THE DRAWINGS

Preferred embodiments of the invention will now be described in further details. Other features and advantages of the present invention will become better understood with regard to the following detailed description and accompanying drawings where.

BEST MODE FOR CARRYING OUT THE INVENTION

Figure 1A:
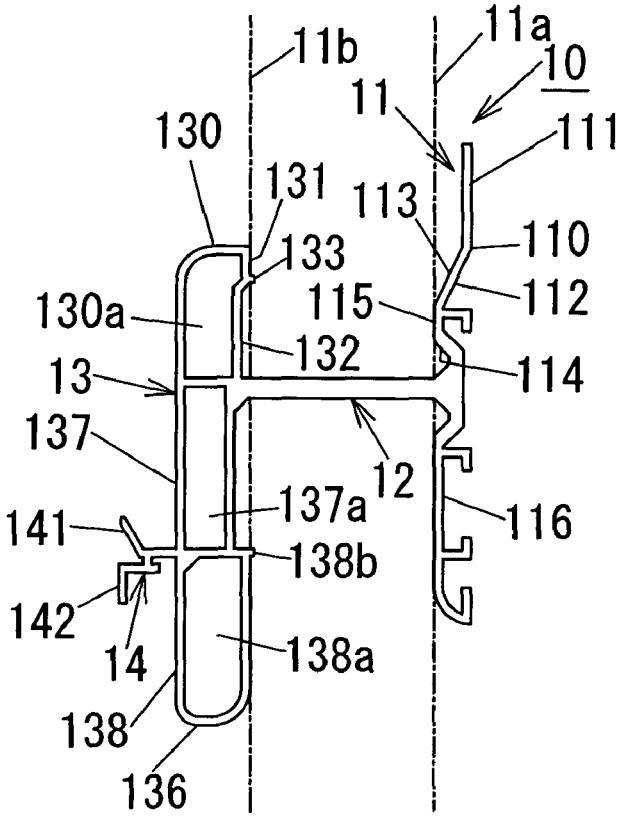
FIGS. 1A and 1B are a right side view and front view of a wall materials bracket of a first embodiment according to the present invention, respectively.
Figure 1B:
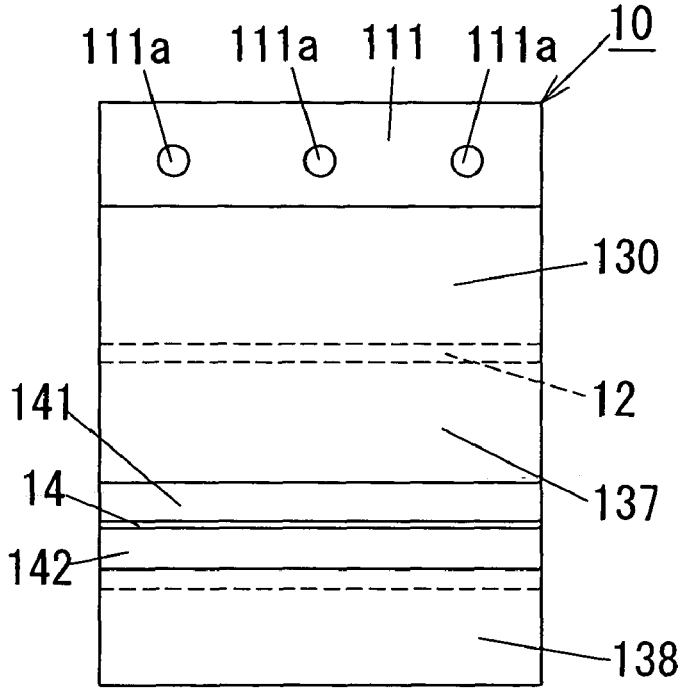
Figure 2:
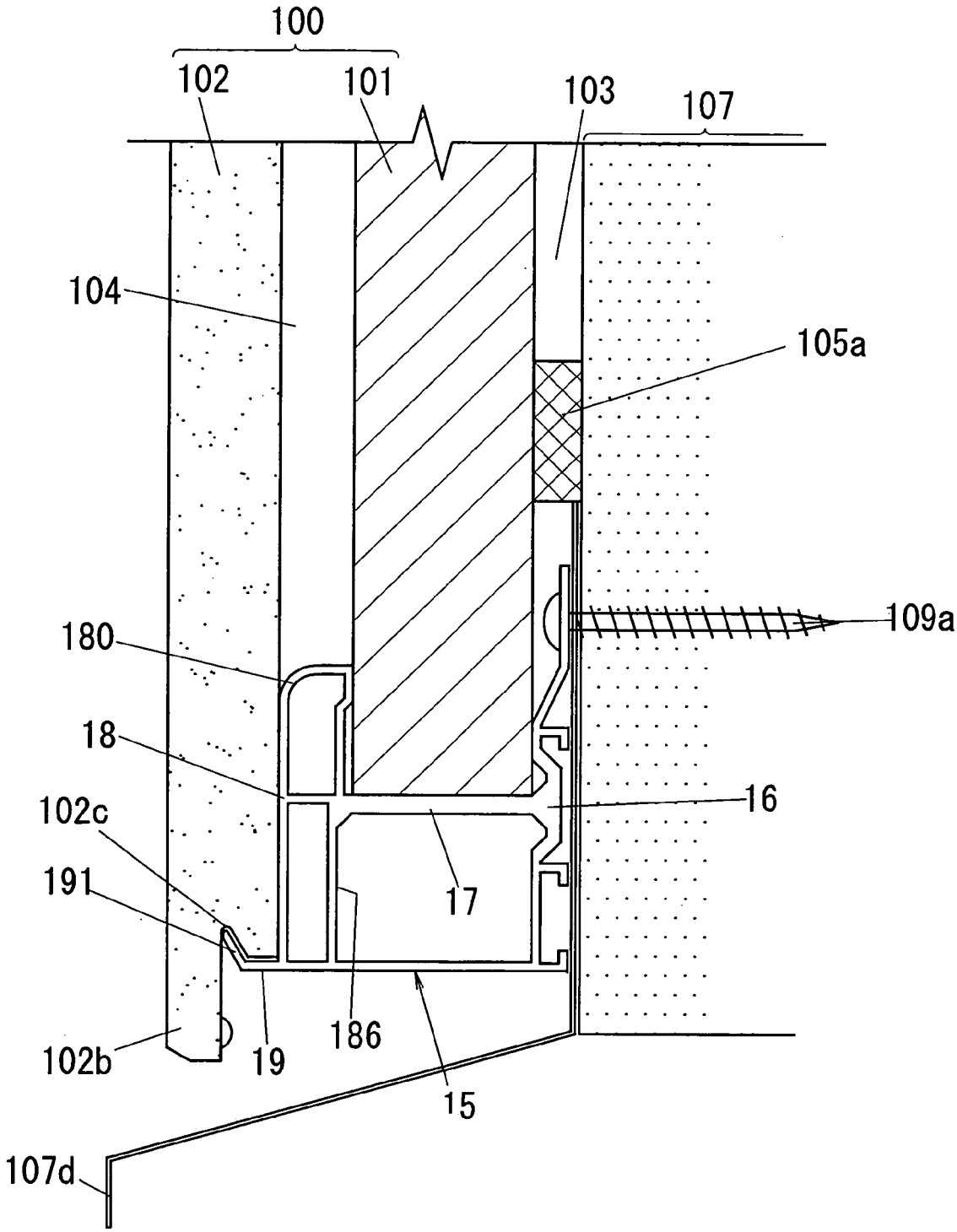
FIG. 2 is a sectional view of the lower section of an insulating wall structure of the first embodiment as seen from right side.
Figure 3:
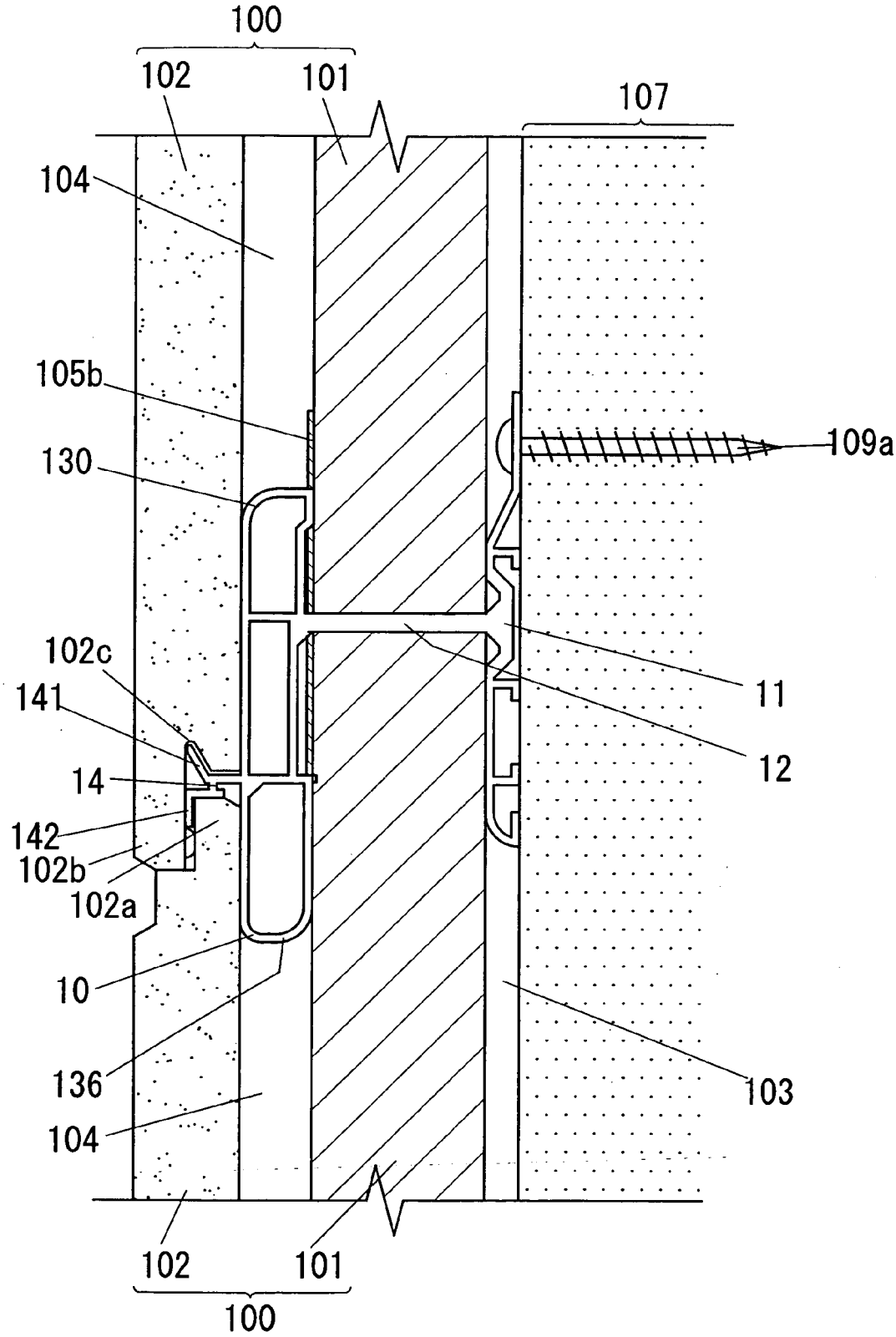
FIG. 3 is a sectional view of the intermediate section of the insulating wall structure as seen from right side.
Figure 4:
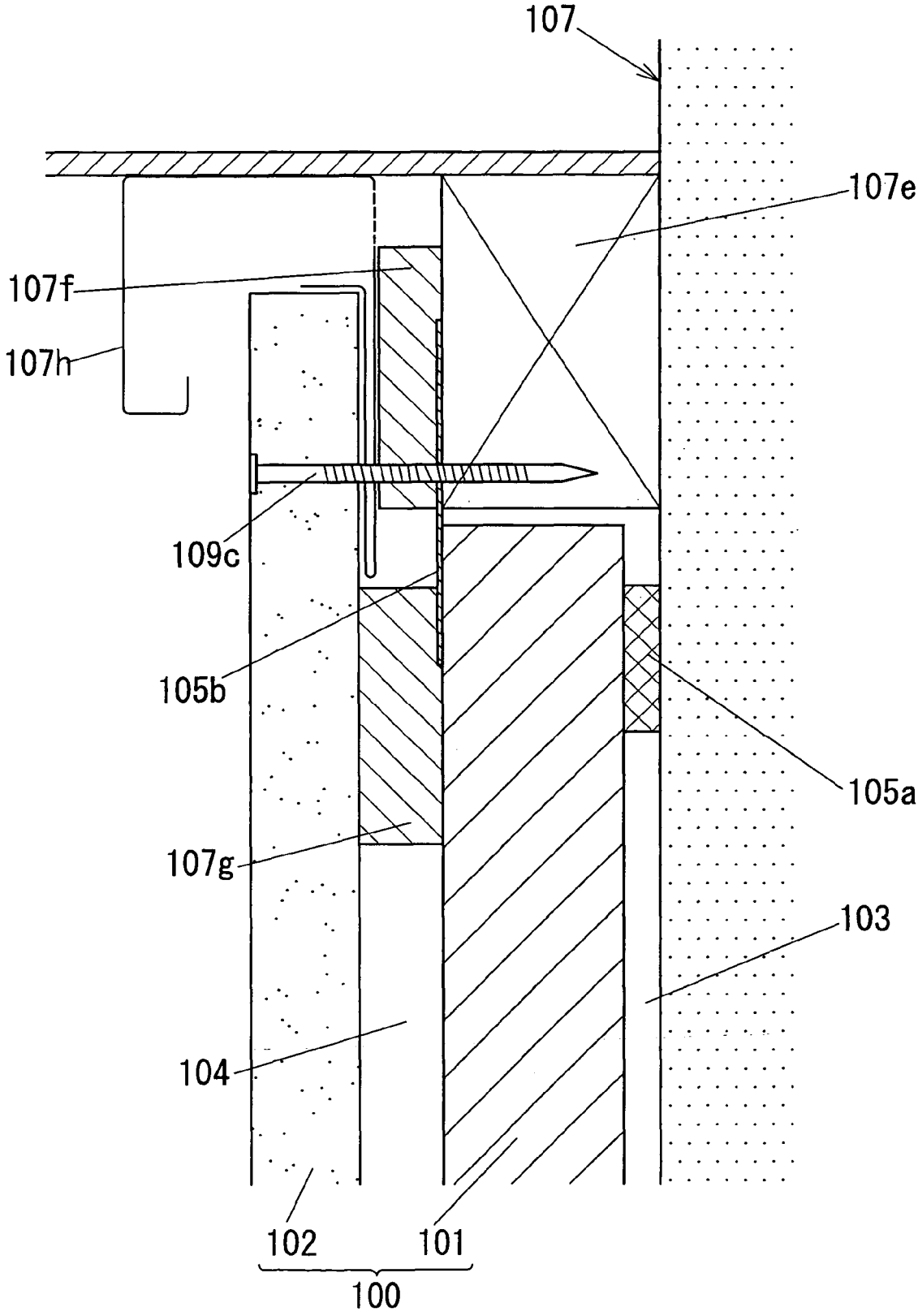
FIG. 4 is a sectional view of the upper section of the insulating wall structure as seen from right side.

FIGS. 1A and 1B show a wall materials bracket 10 of a first embodiment according to the present invention, and FIGS. 2-4 show an insulating wall structure of the first embodiment. As shown in these FIGS., in order to fix insulations (each of which is denoted by 101) and external wall boards (102) as wall materials 100 on a wall substrate 107, the bracket 10 is used together with other same brackets as straight joiners (10) and wall materials brackets as straight starters (15).

The insulation 101 is a board such as, for example, a resin foam molding made from urethane foam, phenol foam, etc., a fiber assembly made from glass wool, rock wool, etc. or the like.

The external wall board 102 is, for example, a fiber reinforced cement board or the like. The external wall board 102 has an upper flange 102*a* formed over the back of the top of the board 102, a lower flange 102*b* formed over the front of the bottom of the board 102, and a slot 102*c* formed just behind the root of the flange 102*b*. These upper and lower flanges function as ship-lap joint for jointing upper and lower two external wall boards (see FIG. 3).

The wall substrate 107 is, for example, an existing wall that includes wall boards and so on. However, not limited to this, the wall substrate of the present invention may be any of various structure of wall substrates in general wooden, steel-frame or reinforced concrete buildings (houses) regardless of building, remodeling or the like.

The bracket 10 is one metal (e.g., stainless steel, aluminum, etc.) molding for fixing the wall materials 100 on the wall substrate 107, and has a flat plate-shaped base piece 11, a flat plate-shaped catching piece 12, a spacing piece 13 and a holding piece 14. This bracket 10 has also dimensions of, for example, approximately 50×80×48 mm (width×height×depth). However, the wall materials bracket of the present invention may be a long-size metal molding that is, for example, the same as or longer than the external wall board 102 in width, and also may be a plastic molding such as rigid plastic, etc.

The base piece 11 is further subdivided into upper and lower parts 110 and 116 by the catching piece 12, and has a plurality (e.g., 3 in FIG. 1B) of through holes (111*a*) at a flat upper half 111 of the upper part 110. However, the number of the through holes may be one. The base piece 11 is fixed on the outer surface of the wall substrate 107 with a fixing element 109*a* such as screw or nail inserted into at least one through hole 111*a*, and is interposed between the wall substrate 107 and upper and lower two insulations 101, 101 to form an air layer 103 between the wall substrate 107 and the two insulations (see FIG. 3). Upper side and lower side of the air layer 103 are connected each other through space between the bracket 10 and other bracket(s) 10, while the air layer 103 is sealed to function as an airtight layer.

The upper half 111 of the upper part 110 is located behind a reference plane 11*a* for restricting the inward (backward) movement of the upper and lower two insulations. A lower half 112 of the upper part 110 is formed into a shape with bow-shaped cross section having slopes 113 and 114 extending diagonally upward and downward from its center part 115 whose front surface is located on the reference plane 11*a*. The front surface of the lower part 116 is almost located on the reference plane 11*a*.

The catching piece 12 is formed to protrude outward (forward) from between the upper and lower parts 110 and 116 of the base piece 11, and holds the bottom end of the upper insulation 101 and the top end of the lower insulation 101 to restrict the downward movement of the upper insulation 101 and the upward movement of the lower insulation 101.

The spacing piece 13 is further subdivided into upper and lower parts 130 and 136 by the catching piece 12, and is formed at the tip of the catching piece 12 so that the upper and lower parts 130 and 136 face the upper and lower parts 110 and 116 of the base piece 11, respectively. This spacing piece 13 sandwiches the bottom of the upper insulation 101 and the top of the lower insulation 101 between the base piece 11 and the spacing piece 13, while the spacing piece 13 is interposed between the upper and lower two insulations 101, 101 and upper and lower two external wall boards 102, 102 to form an air layer 104 between the two insulations and the two external wall boards. Accordingly, the thickness of the air layer 104 can be adjusted by changing the depth of the spacing piece 13. Upper side and lower side of the air layer 104 are connected each other through space between the bracket 10 and other bracket(s) 10, while the air layer 104 is connected to the open air through at least space among each wall materials bracket 15 and functions as a vent layer.

The upper part 130 is formed into pipe-shape with a hole 130*a* along the width direction of the bracket 10, and has a protrusion 131 and a cavity 132 at its back. The protrusion 131 is remained at the back of the upper part 130 so as to be above the center part 115 in the lower half 112 of the base piece 11, and the end surface of the protrusion 131 is located on a reference plane 11*b* for restricting the outward (frontward) movement of the upper and lower two insulations. On the other hand, the cavity 132 is formed under the protrusion 131, and the bottom of the cavity 132 is located in front of the reference plane 11*b*. Also, the protrusion 131 is provided with a strip (long narrow piece) 133 at its lower end. However, the protrusion 131 may be provided with bosses instead of the strip.

The lower part 136 is formed into pipe-shape with an upper hole 137*a* and a lower hole 138*a* along the width direction of the bracket 10, and includes an upper half 137 with the hole 137*a* and a lower half 138 with the hole 138*a*. The outer surface of the back of the upper half 137 is located in front of the reference plane 11*b*, while the outer surface of the back of the lower half 138 is located on the reference plane 11*b*. The lower half 138 is also provided with a strip 138*b* at the upper end of the outer surface of the half 138.

Also, in order to make it easy to put the wall materials 100 on the bracket 10, the spacing piece 13 has rounded edges at its upper front end as well as lower front and rear ends. The outer surfaces of the front of the upper and lower parts 130 and 136 are located on the same plane. The holes 130*a*, 137*a* and 138*a* can be omitted.

The holding piece 14 is formed outside of the spacing piece 13 and below the catching piece 12, and has an upper holding part 141 and a lower holding part 142. The upper holding part 141 is formed into a shape with boomerang-shaped cross section protruding upward from the middle position of the halves 137 and 138, and fits into the slot 102*c* of the upper external wall board 102 to restrict its movement. The lower holding part 142 is formed into a shape with L-shaped cross section protruding downward from the lower end of the upper holding part 141, and holds the top of the upper flange 102*a* of the lower external wall board 102 to restrict its movement. Namely, the holding piece 14 holds the upper and lower two external wall boards (102) to restrict their outward and inward movement as well as the downward movement of the upper external wall board 102 and the upward movement of the lower external wall board 102.

The bracket 10 is characterized by a leaning means for leaning the insulation 101 put on the catching piece 12 against the wall substrate 107. The leaning means of the first embodiment is constructed with the upper half 111, the slope 113, the cavity 132 and the strip 133.

The wall materials bracket 15 has a flat plate-shaped base piece 16 and a flat plate-shaped catching piece 17 in the same way as those of the bracket 10, and also has a spacing piece 18 and a holding piece 19 (see FIG. 2). The base piece 16 is interposed between the wall substrate 107 and insulation 101 on the catching piece 17 to form the air layer 103 between them. The catching piece 17 holds the bottom end of the insulation 101 to restrict its downward movement. The spacing piece 18 is further subdivided into upper and lower parts 180 and 186 by the catching piece 17, and the upper part 180 is formed in the same way as that of the spacing piece 13, while the lower end of the lower part 186 is joined to the lower end of the base piece 16. This spacing piece 18 sandwiches the bottom of the insulation 101 between the base piece 16 and the spacing piece 18, and also is interposed between the insulation 101 and the external wall board 102 held with the holding piece 19 to form the air layer 104 between them. The holding piece 19 has an upper holding part 191 in the same way as that of the holding piece 14 but does not have a lower holding part corresponding to that of the holding piece 14. This holding piece 19 holds the external wall board 102 to restrict its outward and inward movement as well as its downward movement. The wall materials bracket 15 may be a long-size metal molding that is, for example, the same as or longer than the external wall board 102 in width, and also may be a plastic molding such as rigid plastic, etc.

An installing of the insulating wall structure elements is now explained. First, as shown in FIG. 2, a drip 107*d* and first row of brackets (15) are fixed on the outer surface of the bottom of the wall substrate 107 with fixing elements (109*a*). Each bracket is arranged at a position corresponding to, for example, each side end of each external wall board 102. The fixing elements are fixed to the wall substrate 107.

The bottom of a first insulation 101 is then inserted between each base piece 16 and each upper part 180 of the first row of brackets, and the first insulation 101 is put on each catching piece 17 of the first row of brackets. At this process, packing 105*a* is interposed between the wall substrate 107 and the first insulation 101 in order to seal the air layer 103. The packing 105*a* is a foam-based resin tape including EPDM rubber as main component, or the like.

Each upper holding part 191 of the first row of brackets is then fit into the slot 102*c* of a first external wall board 102 and the first external wall board 102 is held with the first row of brackets, while (as shown in FIG. 3) second row of brackets (10) are put on the tops of the first insulation 101 and the first external wall board 102, and the second row of brackets are fixed on the outer surface of the wall substrate 107 with fixing elements (109*a*). Concretely, the top of the first insulation 101 is inserted between each base piece 11 and each lower part 136 of the second row of brackets, and the top end of the first insulation 101 is butted against each catching piece 12 of the second row of brackets. On the other hand, the upper flange 102*a* of the top of the first external wall board 102 is fit between each lower part 136 and a tip of each lower holding part 142 of the second row of brackets.

Figure 5:
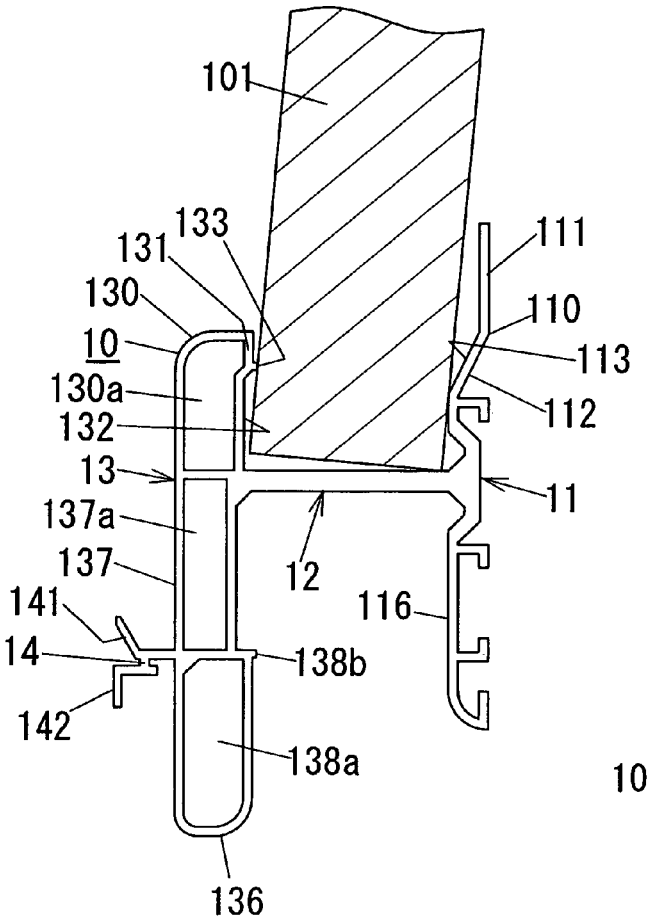
FIG. 5 is a conceptual diagram that illustrates a function of a leaning means in FIG. 1A.

The bottom of a second insulation 101 is then inserted between each base piece 11 and each upper part 130 of the second row of brackets (10), and the second insulation 101 is put on each catching piece 12 of the second row of brackets. At this time, as shown in FIG. 5, by the leaning means constructed with the upper half 111, the slope 113, the cavity 132 and the strip 133, it is possible to lean the second insulation 101 put on each catching piece 12 against the wall substrate 107. Concretely, the strip 133 formed at the protrusion 131 holds the bottom of the insulation 101 toward the wall substrate 107, and the front edge of the bottom enters the cavity 132, and the insulation 101 naturally leans toward the wall substrate 107 on the lower end (fulcrum) of the slope 113.

Next, since a gap corresponding to each catching piece 12 of the second row of brackets is formed between the top end of the first insulation 101 and the bottom end of the second insulation 101, the gap is closed with airtight tape 105*b* that includes a base material without air permeability and an adhesive layer on the base material. At this time, the gap is above the top end of the first external wall board 102 and therefore the gap can be easily closed with the tape 105*b*. On the other hand, as shown in FIGS. 3 and 4, packing 105*a* is interposed between the wall substrate 107 and the second insulation 101 in order to seal the air layer 103. Also, since the second insulation 101 has a slight gap between its top end and a wooden wall furring 107*e* that is previously fixed on the wall substrate 107, the gap is closed with airtight tape 105*b*.

Each upper holding part 141 of the second row of brackets is then fit into the slot 102*c* of a second external wall board 102 and the second external wall board 102 is held with the second row of brackets, while the second external wall board 102 is fixed through upper and lower spacers 107*f*, 107*g* and an ornament 107*h* on the furring 107*e* with fixing element 109*c* such as screw or nail. At this time, the second row of brackets (10) are hidden by the ship-lap joint of the flanges 102*a* and 102*b* of the first and second external wall boards. However, the insulating wall structure may be constructed with three rows or more of insulations and external wall boards.

According to the first embodiment, since the wall materials bracket 10 includes the leaning means for leaning an insulation 101 put on the catching piece 12 against the wall substrate 107, it is possible to free workers from supporting the insulation 101 put on the catching piece 12 and to make work of fixing wall materials easy.

The holding piece 14 is formed outside of the spacing piece 13 and below the catching piece 12 and therefore a gap between upper and lower insulations 101 and 101 can be easily closed with the airtight tape 105*b*.

In addition to the insulations (101), the air layer 103 between the wall substrate 107 and each insulation 101 is sealed to function as the airtight layer that has insulation effect, and therefore insulation efficiency of the insulating wall structure can be enhanced. Also, it is possible to prevent infiltration of rainwater and prevent dew from accumulating. On the other hand, since the air layer 104 between each insulation 101 and each external wall board 102 is connected to the open air to function as the vent layer, dew formation on each external wall board 102 can be prevented. Thus, the insulating wall structure has the airtight layer, the insulations, the vent layer and the external wall boards, so that insulation efficiency, air permeability, water proofing property and sound isolation performance can be enhanced.

Figure 6:
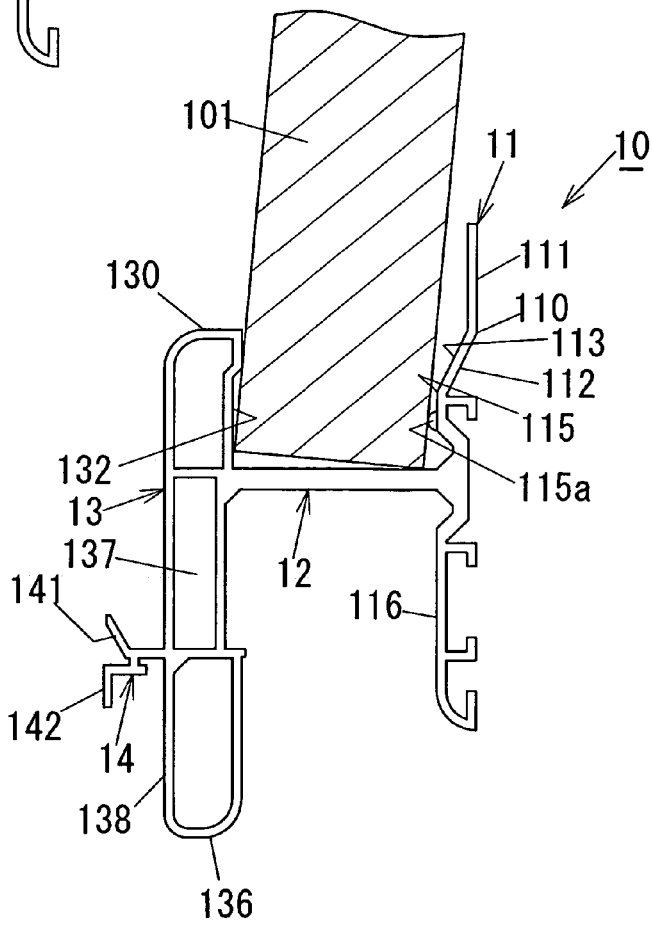
FIG. 6 shows a modified embodiment of a leaning means of FIG. 1A.

In a modified embodiment, as shown in FIG. 6, the bracket 10 is provided with bosses (115*a*) at the lower end of the center part 115 in the lower half 112 of the base piece 11, instead of the bosses (133). In this configuration, each boss 115*a* formed at the base piece 11 holds the bottom end of the insulation 101 outward, and the front edge of the bottom enters the cavity 132, and the insulation 101 leans toward the wall substrate 107. Therefore, by an alternate leaning means constructed with the upper half 111, the slope 113, the cavity 132 and the bosses (115*a*), it is possible to lean the insulation 101 put on the catching piece 12 against the wall substrate 107.

Figure 7:
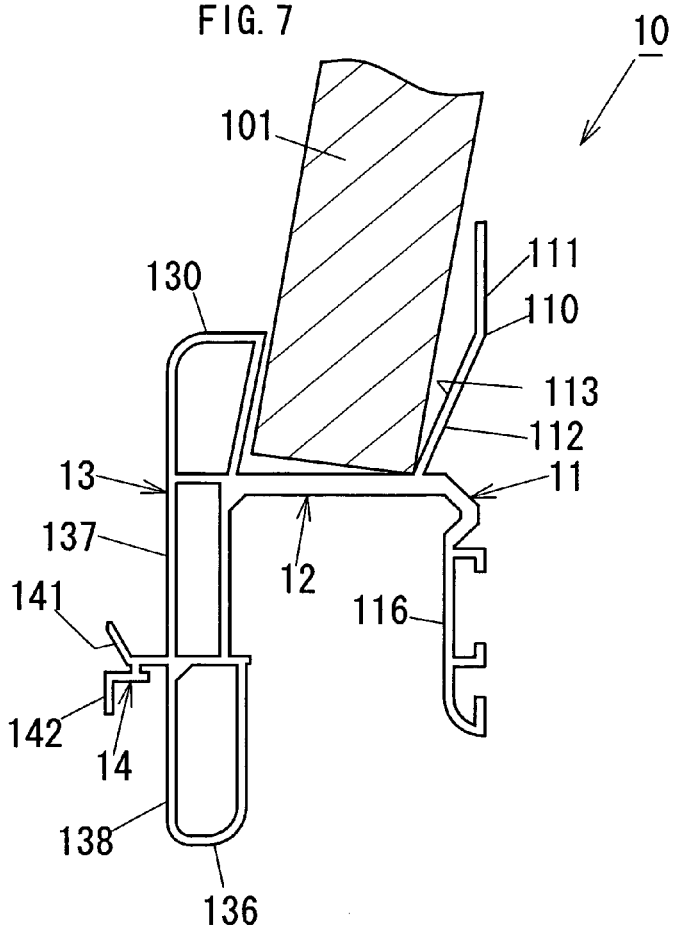
FIG. 7 shows a varied embodiment of the leaning means of FIG. 1A.

In a varied embodiment, as shown in FIG. 7, all of the lower half 112 is a slope without the lower part 114 and the center part 115, and all of the back of the upper part 130 is also a slope without the protrusion 131, the cavity 132 and the strip 133. In this configuration, the insulation 101 put on the catching piece 12 leans toward the wall substrate 107 by the upper half 111, the lower half 112 (slope) and the back of the upper part 130 (slope). Therefore, by an alternate leaning means constructed with the upper half 111, the lower half 112 and the back of the upper part 130, it is possible to lean the insulation 101 put on the catching piece 12 against the wall substrate 107.

Figure 8A:
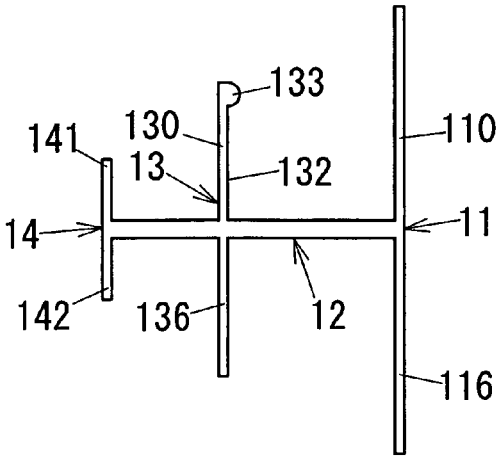
FIGS. 8A and 8B show variation examples of the wall materials bracket of FIG. 1A.
Figure 8B:
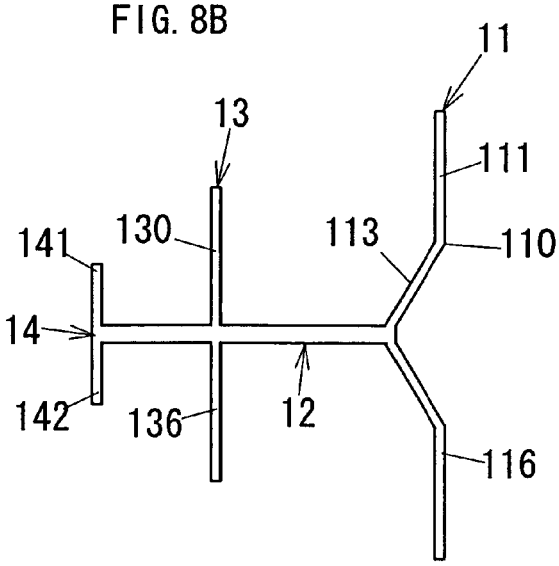

As shown in FIGS. 8A and 8B, the spacing piece 13 may be formed into a flat plate shape, and the holding piece 14 may be located at the same height as the catching piece 12.

Figure 9A:
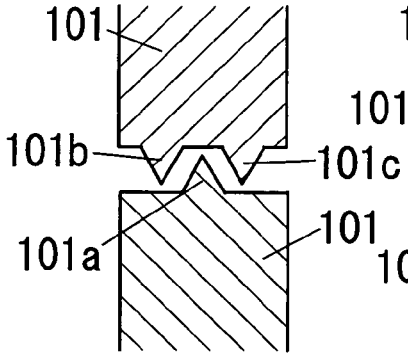
FIGS. 9A, 9B and 9C show an alternate embodiment of the insulations included in the insulating wall structure.
Figure 9B:
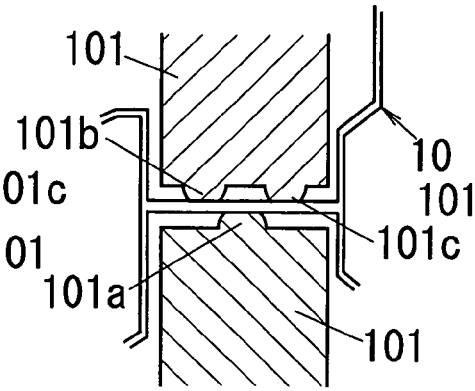
Figure 9C:
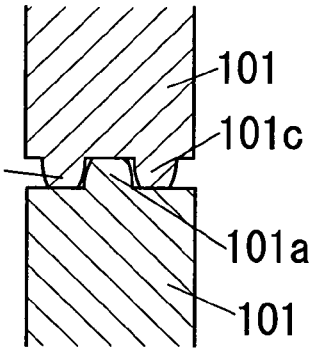
Figure 10:
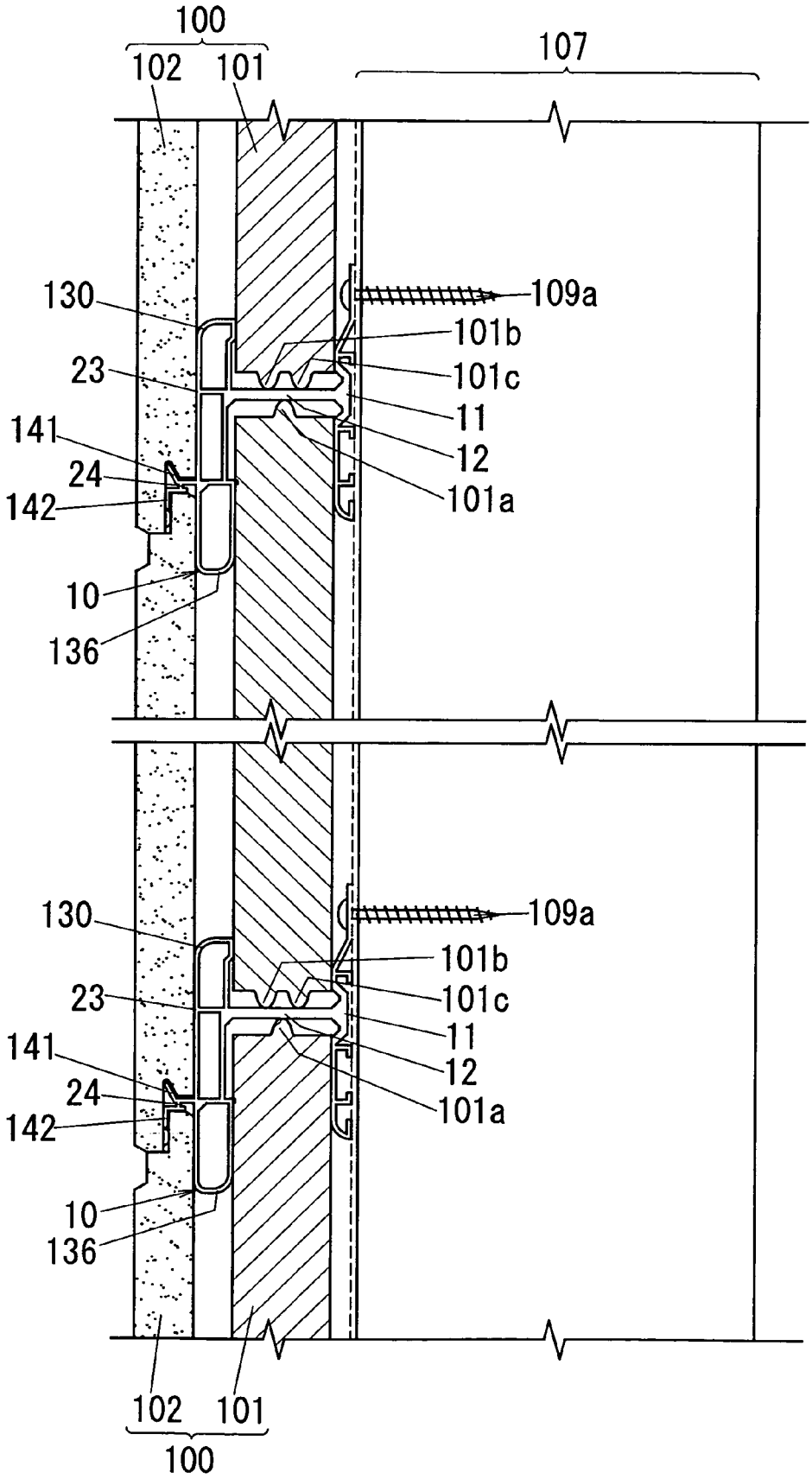
FIG. 10 is a sectional view of the insulations transformed on brackets.

In an alternate embodiment, as shown in FIG. 9A, the insulating wall structure includes insulations (101) butted together along the vertical direction, and one of them has a transformable tongue 101*a* which is pressed against a butt end of another of them. Concretely, the insulation 101 has the tongue 101*a* over the center of the upper butt end (upper surface), and also has tongues 101*b* and 101*c* on both sides of the center of the lower butt end (lower surface). These tongues are provided in order to close a gap corresponding to the catching piece of each bracket, and the tongues are transformed as shown in FIGS. 9B and 10 on each bracket 10, while the tongues are transformed as shown in FIG. 9C between brackets. However, the number of the tongue on each butt end may be three or more. Also, the insulation 101 may have a groove for tongue and groove joint instead of the tongues 101*b* and 101*c*.

Figure 11:
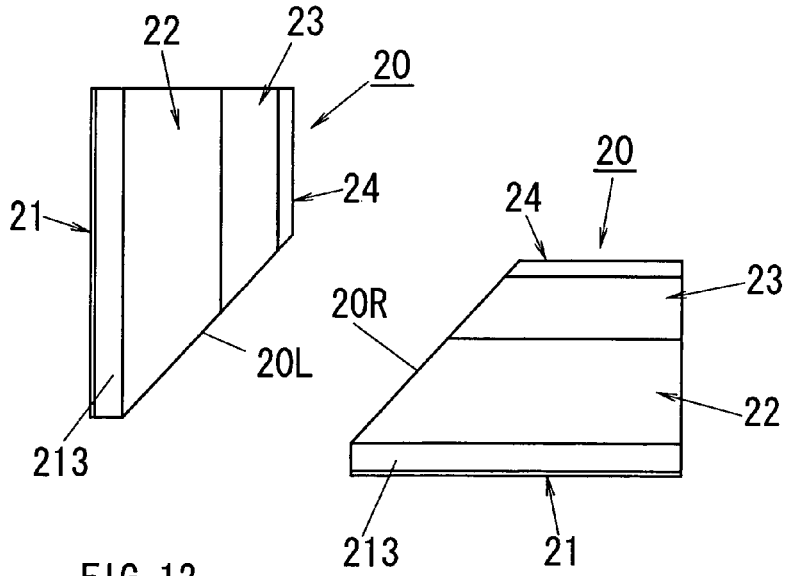
FIG. 11 is a top view of wall materials brackets of a second embodiment according to the present invention.
Figure 12:
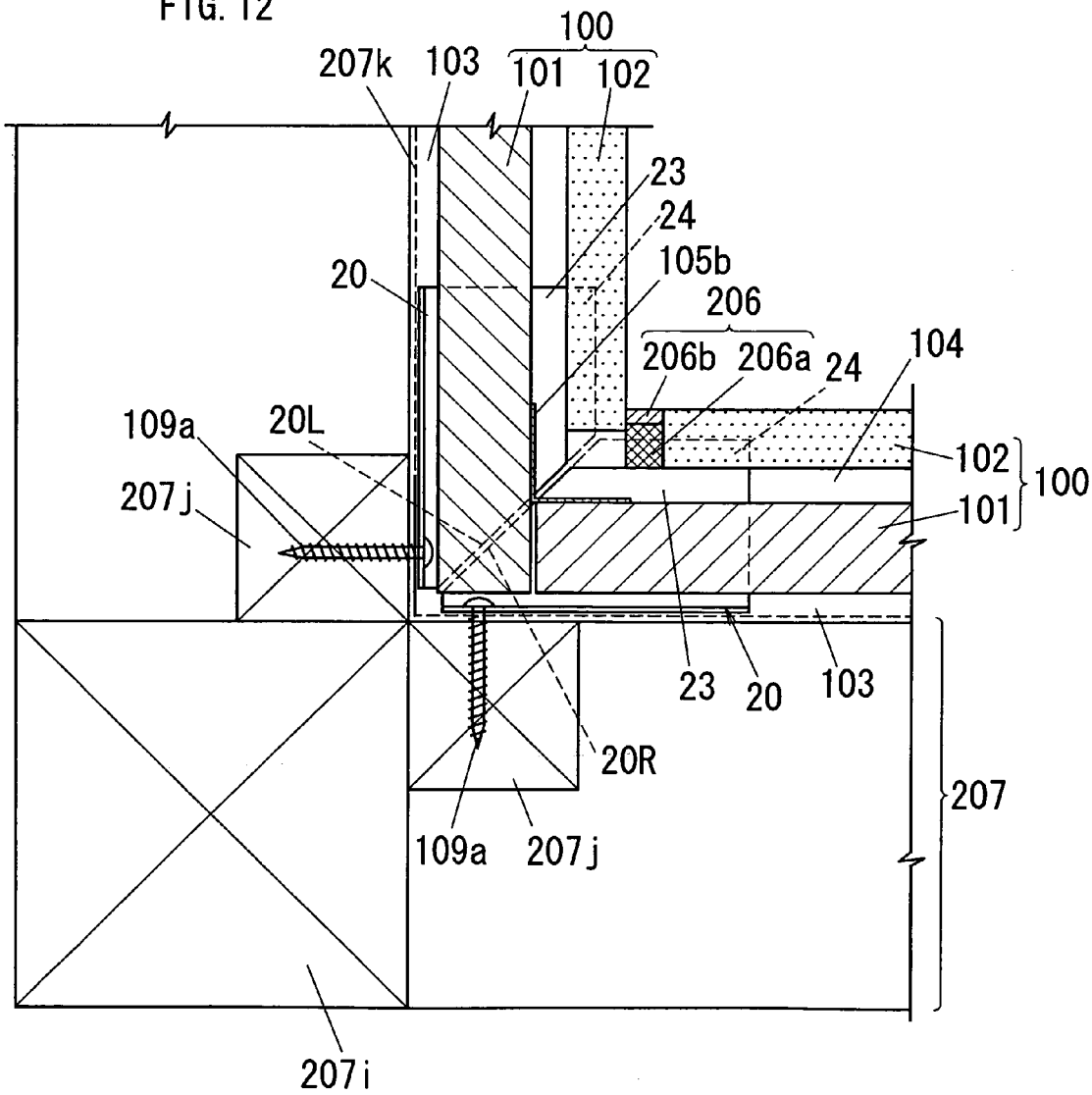
FIG. 12 is a sectional view of an insulating wall structure of the second embodiment as seen from above.

FIG. 11 shows wall materials brackets (20) of a second embodiment according to the present invention, and FIG. 12 shows an insulating wall structure of the second embodiment. As shown in these FIGS., the bracket 20 is used together with other same brackets as reentrant corner joiners (20), wall materials brackets as reentrant corner starters (not shown), wall materials brackets as straight joiners (not shown), and wall materials brackets as straight starters (not shown) in order to fix insulations (101) and external wall boards (102) as wall materials 100 on a wall substrate 207.

The straight joiner, the straight starter, the insulation 101 and the external wall board 102 are the same as those of the first embodiment.

The wall substrate 207 is, for example, wall substrate in home building and includes frames (207*i*) such as pillars, studs or the like (e.g., pillar in FIG. 12), supplementary frames (207*j*) and waterproofing sheet(s) 207*k* with water vapor permeability. In FIG. 12, each supplementary frame 207 *j* is directly fixed on the pillar of the frame 207*i*.

The bracket 20 has a base piece 21, a catching piece 22, a spacing piece 23 and a holding piece 24 in the same way as those of the wall materials bracket 10 of the first embodiment, and further has a right butt edge 20R or a left butt edge 20L. The butt edge 20R or 20L is formed at right or left side end of the bracket 20 as seen from the holding piece side, respectively and inclines at an angle corresponding to a reentrant corner of the wall substrate 207. Left and right brackets (20) respectively having the butt edges 20R and 20L are used at each reentrant corner of the wall substrate 207. In FIG. 11, 213 is a slope in the lower half of the upper part of the base piece 21 and constitutes a leaning means together with an upper half of the upper part, and a cavity and a strip in the upper part of the spacing piece 23 in the same way as that of the first embodiment. The reentrant corner starter also has a right butt edge or a left butt edge in the same way as the bracket 20.

Mainly different points from installing of the insulating wall structure elements of the first embodiment are explained below. As shown in FIG. 12, a left bracket 20 with the butt edge 20R is fixed through the waterproofing sheet 207*k* on the left supplementary frame 207*j* in the reentrant corner of the wall substrate 207 with a fixing element(s) 109*a*, while a right bracket 20 with the butt edge 20L is fixed through the waterproofing sheet 207*k* on the right supplementary frame 207*j* in the reentrant corner with a fixing element(s) 109*a*. At this time, the butt edges 20R and 20L are substantially butted together. As well, reentrant corner starters with the right butt edge and the left butt edge are also fixed through the waterproofing sheet on the left and right supplementary frames, respectively.

A side end of one of neighboring insulations 101 and 101 held by the brackets is butted against front edge of the other, and the butted seam is closed with airtight tape 105*b* in order to seal the air layer 103.

On the other hand, neighboring external wall boards 102 and 102 held by the brackets are jointed together through waterproof materials 206 including backup material 206*a* and sealant 206*b*. The air layer 104 is connected to the open air. The backup material 206*a* is a square pole or cylinder shaped resin foam molding made from polyethylene foam or the like. The sealant 206*b* is silicon based sealant, polysulfide based sealant, acrylic urethane based sealant, polyurethane based sealant, acrylic based sealant, styrene butadiene rubber based sealant, butyl rubber based sealant, or the like.

According to the second embodiment, since the left and right brackets 20 and 20 can be located in immediate proximity to the reentrant corner edge of the wall substrate 207, each bracket 20 can be fixed on each supplementary frame 207*j* directly fixed on the pillar of the frame 207*i*. The reentrant corner starters also have same advantage. Therefore, it is possible to firmly fix the wall materials 100 on the reentrant corner of the wall substrate 207 with the reentrant corner joiners (20) and the reentrant corner starters.

Figure 13:
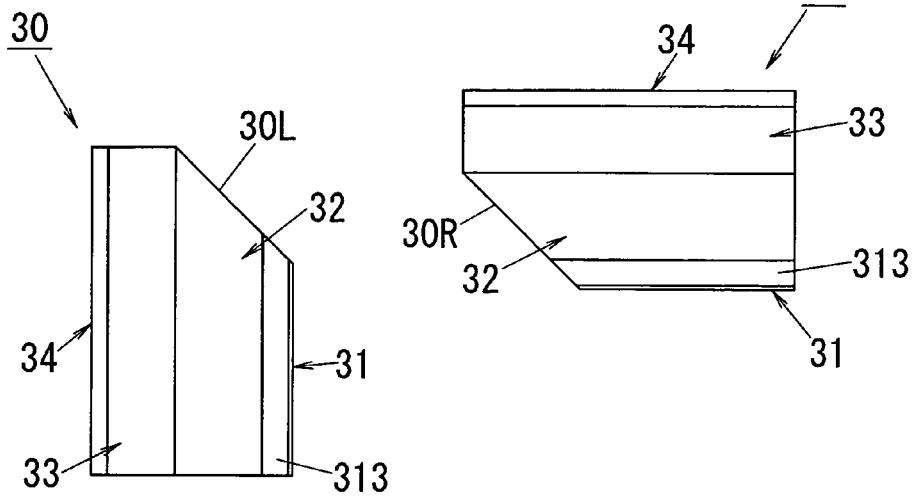
FIG. 13 is a top view of wall materials brackets of a third embodiment according to the present invention.
Figure 14:
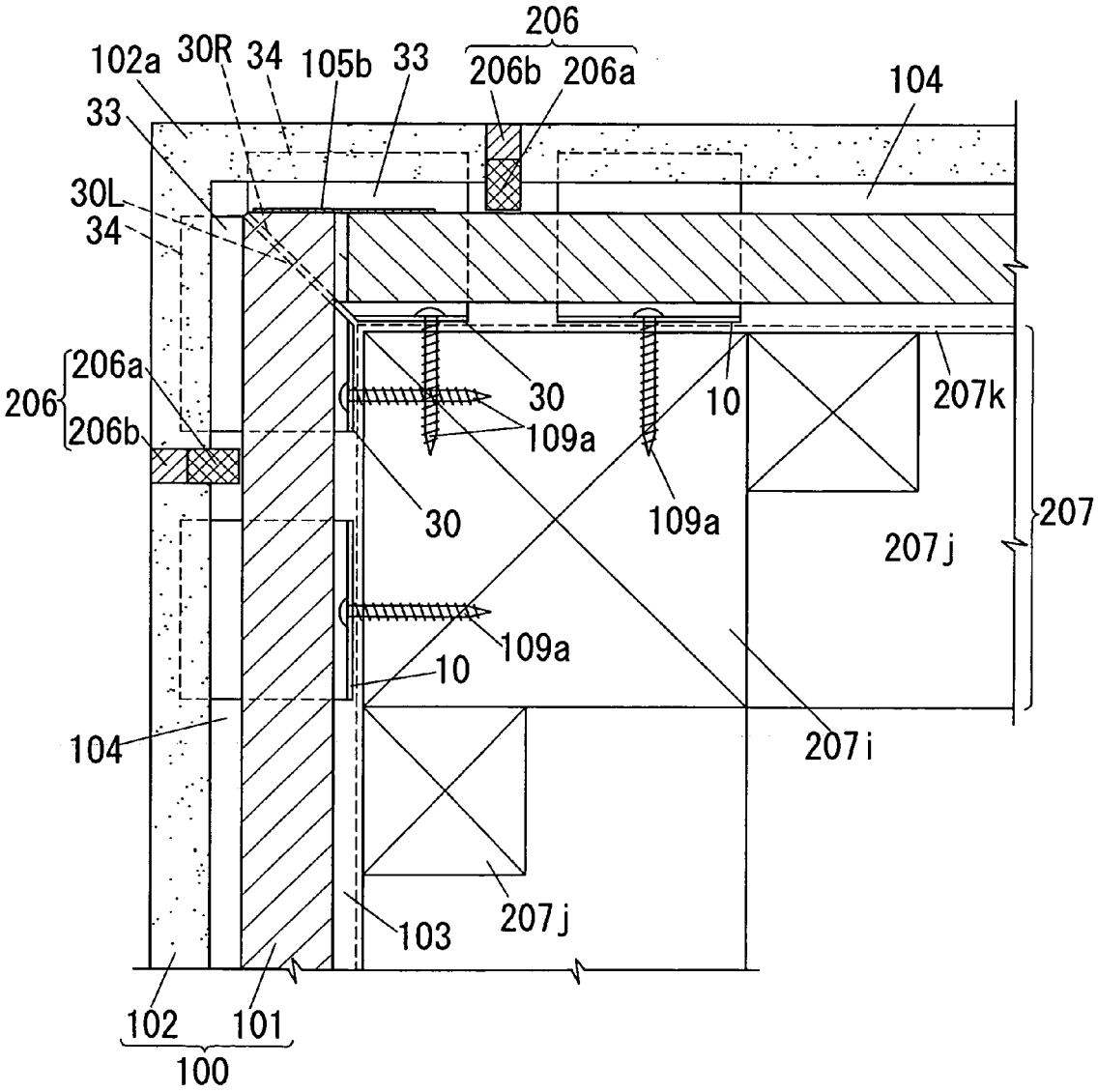
FIG. 14 is a sectional view of an insulating wall structure of the third embodiment as seen from above.

FIG. 13 shows wall materials brackets (30) of a third embodiment according to the present invention, and FIG. 14 shows an insulating wall structure of the third embodiment. As shown in these FIGS., the bracket 30 is used together with other same brackets as salient corner joiners (30), wall materials brackets as salient corner starters (not shown), wall materials brackets as reentrant corner joiners, wall materials brackets as reentrant corner starters (not shown), wall materials brackets as straight joiners (not shown), and wall materials brackets as straight starters (not shown) in order to fix insulations (101) and external wall boards (102) as wall materials 100 on a wall substrate 207.

The reentrant corner joiner, the reentrant corner starter, the straight joiner, the straight starter, the insulation 301, the external wall board 302 and wall substrate 307 are the same as those of the second embodiment.

The bracket 30 has a base piece 31, a catching piece 32, a spacing piece 33 and a holding piece 34 in the same way as those of the wall materials bracket 10 of the first embodiment, and further has a right butt edge 30R or a left butt edge 30L. The butt edge 30R or 30L is formed at right or left side end of the bracket 30 as seen from the holding piece side, respectively and inclines at an angle corresponding to a salient corner of the wall substrate 207. Left and right brackets (30) respectively having the butt edges 30R and 30L are used at each salient corner of the wall substrate 207. In FIG. 13, 313 is a slope in the lower half of the upper part of the base piece 31 and constitutes a leaning means together with an upper half of the upper part, and a cavity and a strip in the upper part of the spacing piece 33 in the same way as that of the first embodiment. The salient corner starter also has a right butt edge or a left butt edge in the same way as the bracket 30.

Mainly different points from installing of the insulating wall structure elements of the first embodiment are explained below. As shown in FIG. 14, a left bracket 30 with the butt edge 30R is fixed through the waterproofing sheet 207*k* on the pillar of the frame 207*i* in the left side of the salient corner of the wall substrate 207 with a fixing element(s) 109*a*, while a right bracket 30 with the butt edge 30L is fixed through the waterproofing sheet 207*k* on the pillar of the frame 207*i* in the right of the salient corner with a fixing element(s) 109*a*. At this time, the butt edges 30R and 30L are substantially butted together. As well, salient corner starters with the right butt edge and the left butt edge are also fixed through the waterproofing sheet on the pillar of the frame 207*i*.

A side end of one of neighboring insulations 101 and 101 held by the brackets is butted against back edge of the other, and the butted seam is closed with airtight tape 105*b* in order to seal the air layer 103. On the other hand, a L-shaped external wall board 102*a* held by the brackets is jointed through waterproof materials 206 against external wall boards (102) held by straight joiners (10) and the straight starters. The air layer 104 is connected to the open air.

According to the third embodiment, it is possible to firmly fix the wall materials 100 on the salient corner of the wall substrate 207 with the salient corner joiners (30) and the salient corner starters. Especially, the L-shaped external wall board 102*a* can be firmly fixed on the salient corner.

Figure 15:
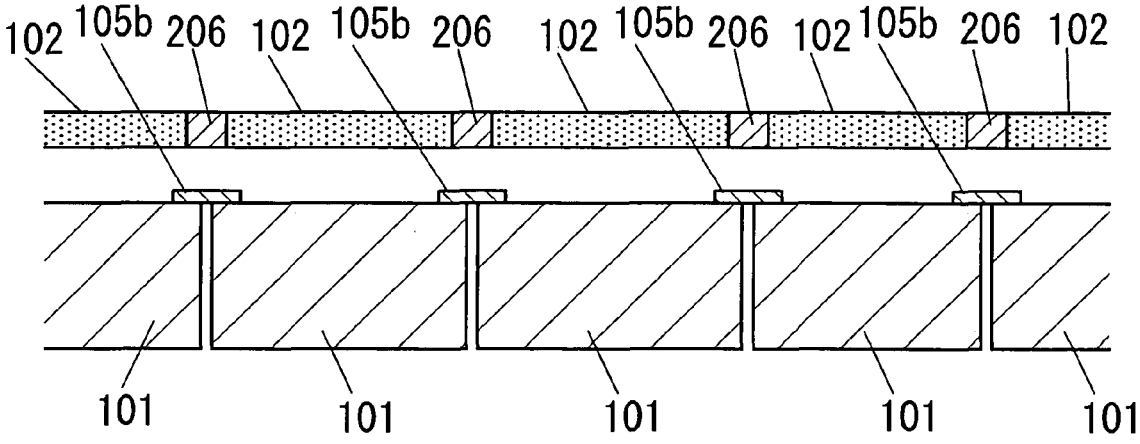
FIG. 15 shows a modified embodiment of the insulating wall structure.

In a modified embodiment, as shown in FIG. 15, the insulating wall structure includes airtight tape 105*b* and waterproof materials 206. The airtight tape 105*b* seals between insulations 101 and 101 neighboring each other in the insulations (101) fixed and arranged side by side with above each bracket. The waterproof materials 206 waterproofs between external wall boards 102 and 102 neighboring each other in the external wall boards (102) fixed and arranged side by side with each bracket. In addition, the insulation 101 has a width substantially equal to one or more times width (e.g., one time width in FIG. 15) of the external wall board 102. As a result, since every side (vertical surface, but not the front or back) of each insulation 101 substantially corresponds to a side of any external wall board 102, the insulations and the external wall boards can be effectively installed. It is also easy to seal between insulations 101 and 101 neighboring each other with the airtight tape 105*b* and to waterproof between external wall boards 102 and 102 neighboring each other with the waterproof materials 206. For example, in Japan, the insulation 101 and the external wall board 102 can have 1,820 mm or 910 mm in width. The external wall board 102 usually has 3,030 mm in width and therefore the insulation 101 can have 3,030 mm, 6,060 mm, 9,090 mm or the like. However, not limited to this, when position difference of the corresponding sides of the insulation 101 and the external wall board 102 is shorter than the width of the bracket 10, the wall materials can be effectively fixed on the wall substrate.

Figure 16:
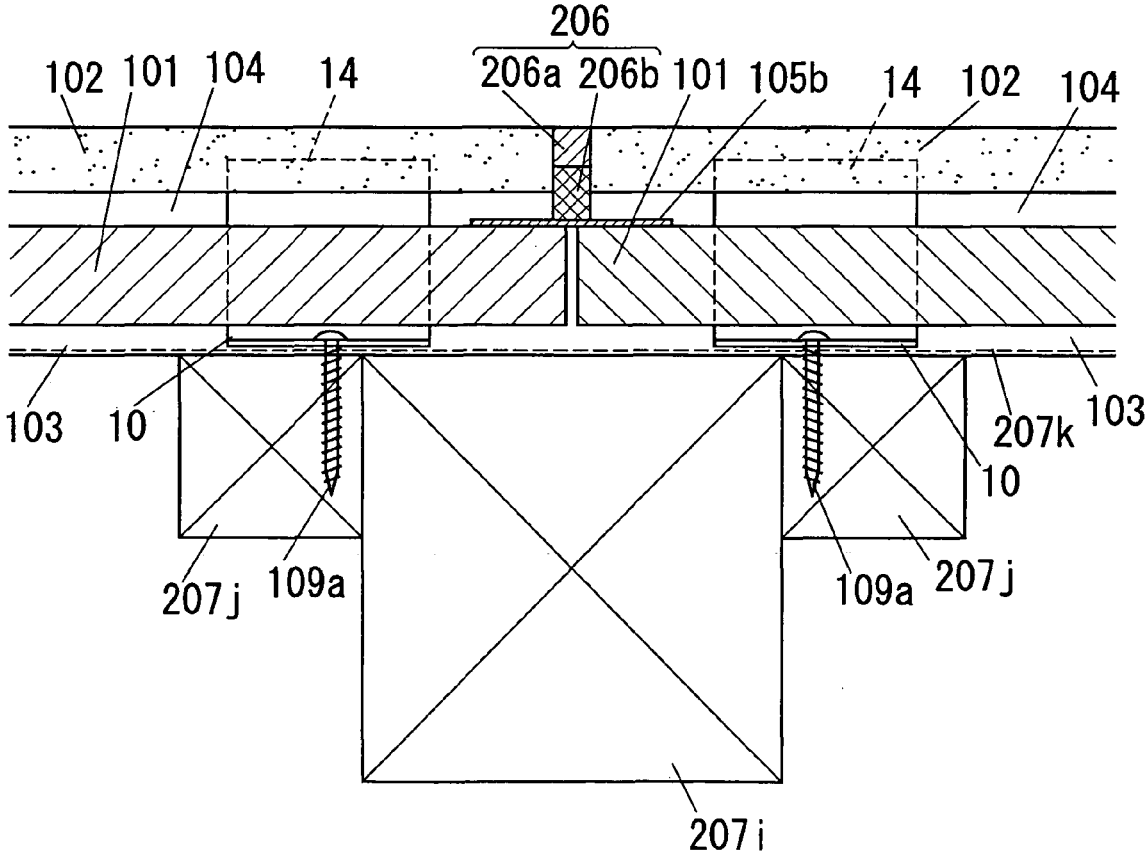
FIG. 16 shows another modified embodiment of the insulating wall structure.

In another modified embodiment, as shown in FIG. 16, the airtight tape 105*b* is pressed with the backup material 206*a* of the waterproof materials 206. Accordingly, even if adhesive power of the airtight tape 105*b* grows weak by secular change and so on, the airtight tape 105*b* is pressed with the waterproof materials 206, so that the airtight tape 105*b* can be prevented from coming off and insulation efficiency can be kept.

Figure 17:
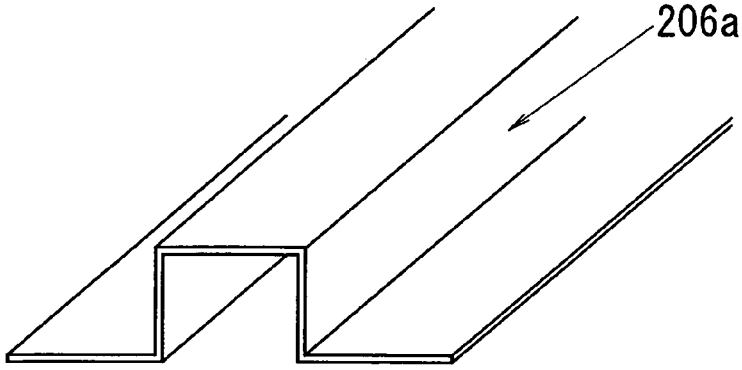
FIG. 17 shows a variation example of the backup material of the waterproof materials used in the insulating wall structure.

FIG. 17 shows a variation example of the backup material 206*a* of the waterproof materials used in the insulating wall structure. A backup material 206*a* of this example is a long-size resin molding with hat-shaped cross section. Brims of the backup material 206*a* are pasted on the surface of the airtight tape 105*b*, and then the sealant 206*b* is filled on the backup material 206*a*.

Figure 18:
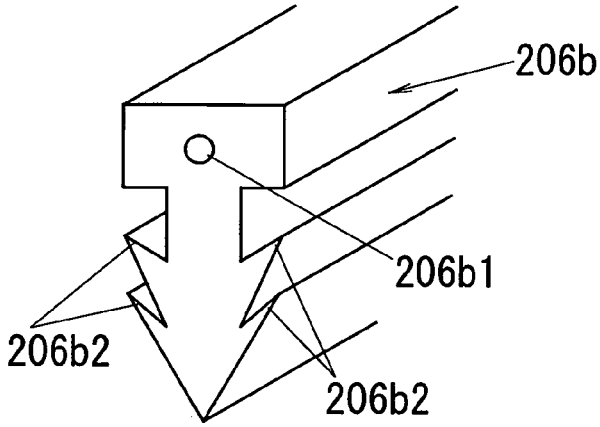
FIG. 18 shows a variation example of the waterproof materials used in the insulating wall structure.

FIG. 18 shows a variation example of the waterproof materials used in the insulating wall structure. A waterproof materials of this example consists of a sealant 206*b* that is a long-size molding (named gasket) made from synthetic resin such as silicone resin or the like, and has no backup material. The sealant 206*b* is formed into a shape with T-shaped cross section, and has a hole 206*b*1 and pleats (206*b*2) at its base and foot, respectively.

Figure 19:
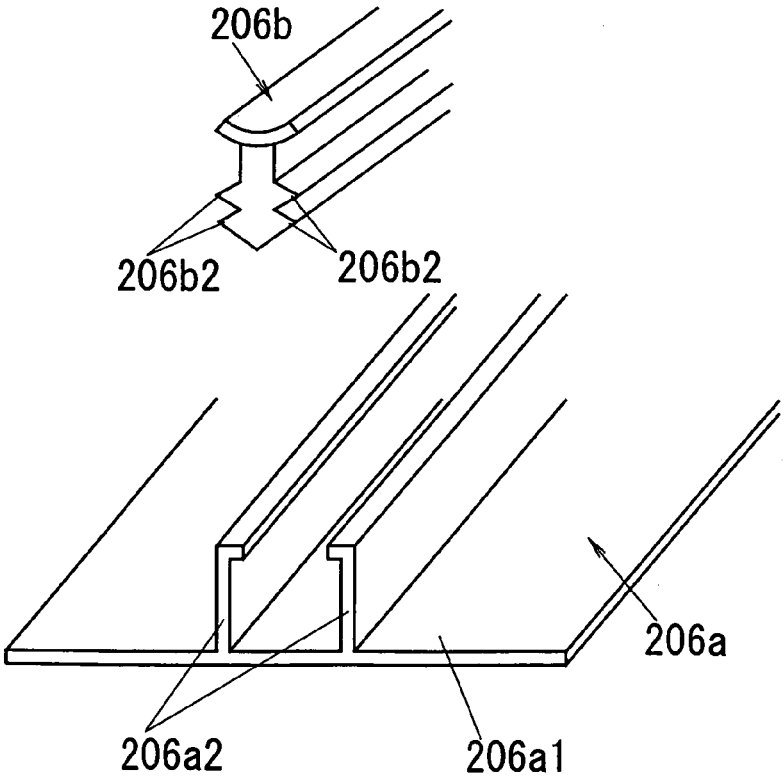
FIG. 19 shows another variation example of the waterproof materials used in the insulating wall structure.

FIG. 19 shows another variation example of the waterproof materials used in the insulating wall structure. A backup material 206*a* of this example is a long-size resin molding with a pair of hooks (206*a*2) on its flat plate-shaped substrate

206*a*1, while a sealant 206*b* is almost same as that of FIG. 18. First, the substrate 206*a*1 is pasted on the surface of the airtight tape 105*b*, and then the foot of the sealant 206*b* is inserted into between the hooks (206*a*2), so that the foot is locked between the hooks.

Figure 20:
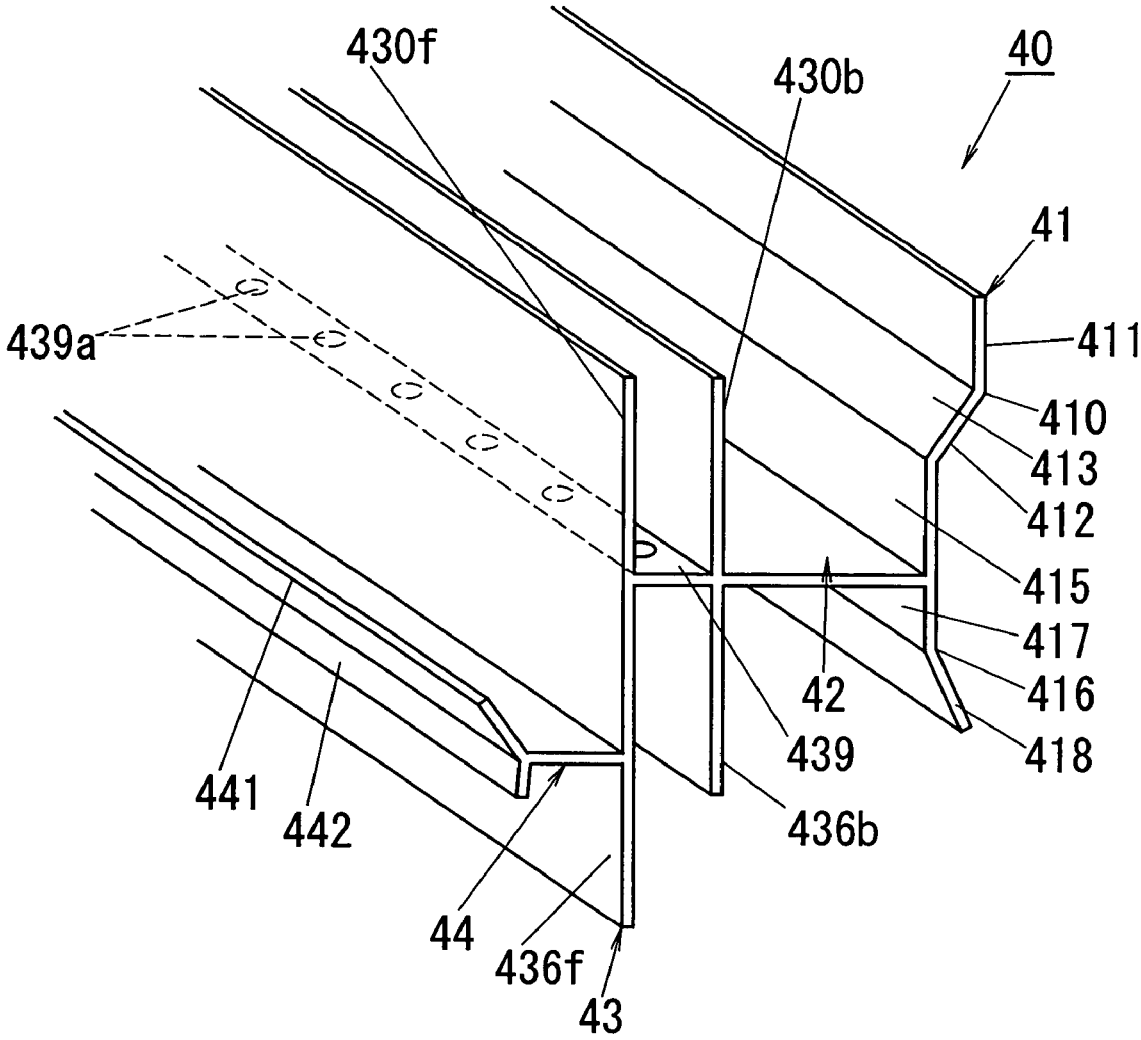
FIG. 20 is a perspective view of a wall materials bracket of a fourth embodiment according to the present invention.

FIG. 20 shows a wall materials bracket 40 of a fourth embodiment according to the present invention. This bracket 40 is a long-size molding with long width, and has a flat plate-shaped base piece 41, a flat plate-shaped catching piece 42, a spacing piece 43 and a holding piece 44.

The base piece 41 is further subdivided into upper and lower parts 410 and 416 by the catching piece 42, and has through holes (not shown) at a flat upper half 411 of the upper part 410. The upper half 411 is located behind a reference plane for restricting the inward (backward) movement of upper and lower two insulations. A lower half 412 of the upper part 410 is formed into a shape with a slope 413 and a back holder 415. The slope 413 extends diagonally downward from the lower end of the upper half 411 to the reference plane. The back holder 415 extends vertically from the lower end of the slope 413 to the base end of the catching piece 42. The front surface of upper half 417 of the lower part 416 is located on the reference plane, while a lower half 418 extends diagonally backward from the lower end of the upper half 417. The catching piece 42 is the same as that of the first embodiment.

The spacing piece 43 is further subdivided into upper parts 430*b* and 430*f* and lower parts 436*b* and 436*f* by the catching piece 42, and is formed at the tip of the catching piece 42 so that the upper parts 430*b* and 430*f* and the lower parts 436*b* and 436*f* face the upper part 410 and the lower part 416, respectively. The upper and lower parts 430*f* and 436*f* are separated forward from the upper and lower parts 430*b* and 436*b* by a flat plate-shaped spacing part 439. The spacing part 439 is provided with vents (439*a*). Also, the back surface of the upper part 430*b* is provided with, for example, a strip (or bosses) and a cavity (not shown) as well as the upper part 130 of FIG. 8A. However, the upper part 430*b* may have a protrusion, a cavity and a strip as well as the upper part 130 of FIG. 1A.

The holding piece 44 is formed outside of the spacing piece 43 and below the catching piece 42, and has an upper holding part 441 and a lower holding part 442. The upper holding part 441 is formed as well as that of FIG. 1A, while the lower holding part 442 is formed to extend downward from the center lower part of the upper holding part 441.

According to the fourth embodiment, even if the bracket 40 is the long-size resin molding, the vents (439*a*) are formed at the spacing part 439 of the spacing piece 43, so that an air layer between the insulations and the external wall boards can be made to function as a vent layer.

Although the present invention has been described with reference to certain preferred embodiments, numerous modifications and variations can be made by those skilled in the art without departing from the true spirit and scope of this invention.

What is claimed is:

1. A wall materials bracket for fixing an inner wall board and an external wall board as wall materials on a wall substrate, the wall materials bracket comprising:

a flat-shaped base piece that is configured to be fixed on an outer surface of the wall substrate;

a flat-shaped catching piece that is configured to protrude outward from between upper and lower parts of said base piece, said catching piece configured to hold a bottom or a top end of at least one inner wall board to restrict downward or upward movement of the at least one inner wall board;

a spacing piece that is configured to be interposed between the at least one inner wall board and at least one external wall board to form an air layer between them, said spacing piece being formed at a tip of said catching piece so as to face the upper and lower parts of said base piece, said spacing piece configured to sandwich the at least one inner wall board between the base piece and the spacing piece;

a holding piece that is formed outside of said spacing piece, said holding piece configured to hold the at least one external wall board to restrict outward and inward movement, as well as downward or upward movement of the at least one external wall board; and a leaning device configured to lean the inner wall board put on said catching piece against the wall substrate, wherein said base piece is subdivided into upper and lower parts by the catching piece, while the spacing piece is also subdivided into upper and lower parts by the catching piece, the upper part of the base piece comprising a slope extending diagonally upward from a reference plane to restrict backward movement of the inner wall board, the upper part of the spacing piece comprising a cavity at a side facing the base piece, wherein the leaning device comprises the slope and the cavity, and wherein the slope extends above and away from the cavity.

2. The wall materials bracket of claim 1, wherein the entire holding piece is formed outside of said spacing piece and below said catching piece.

3. The wall materials bracket of claim 1, wherein a butt edge is formed at right or left side end of the wall materials bracket as seen from said holding piece side, said butt edge inclining at an angle corresponding to a reentrant corner of the wall substrate.

4. A wall structure constructed by fixing the wall materials on the wall substrate with the wall materials bracket of claim 3, comprising:

at least two said wall materials brackets that are respectively fixed on the two outer surfaces forming the reentrant corner of said wall substrate with their butt edges butted together;

at least two said inner wall boards that are butted together and held with the catching pieces of said wall materials brackets;

at least two said external wall boards that are held with the holding pieces of said wall materials brackets; and airtight tape that seals between said inner wall boards butted together.

5. The wall materials bracket of claim 1, wherein a butt edge is formed at right or left side end of the wall materials bracket as seen from said holding piece side, said butt edge inclining at an angle corresponding to a salient corner of the wall substrate.

6. A wall structure constructed by fixing the wall materials on the wall substrate with the wall materials bracket of claim 5, comprising:

at least two said wall materials brackets that are respectively fixed on the two outer surfaces forming the salient corner of said wall substrate with their butt edges butted together;

at least two said inner wall boards that are butted together and held with the catching pieces of said wall materials brackets;

at least one said external wall board that is held with the holding pieces of said wall materials brackets; and airtight tape that seals between said inner wall boards butted together.

7. A wall structure constructed by fixing the wall materials on the wall substrate with the wall materials bracket of claim 1, comprising:

a plurality of wall materials brackets that are fixed and arranged in at least one row on an outer surface of said wall substrate;

a plurality of inner wall boards that are fixed and arranged side by side with said plurality of wall materials brackets;

a plurality of external wall boards that are fixed and arranged side by side with said plurality of wall materials brackets;

airtight tape that seals said plurality of inner wall boards adjacent each other; and waterproof materials that waterproof said plurality of external wall boards adjacent each other, wherein each of said plurality of inner wall boards has a width substantially equal to one or more times a width of each of said plurality of external wall boards.

8. A wall structure constructed by fixing the wall materials on the wall substrate with the wall materials bracket of claim 1, including at least two said inner wall boards butted together, one of them having a transformable tongue which is pressed against a butt end of another of them.

9. A wall structure constructed by fixing the wall materials on the wall substrate with the wall materials bracket of claim 1, comprising:

at least one said inner wall board;

at least one said wall materials bracket that is fixed on the outer surface of said wall substrate, said wall materials bracket holding said inner wall board with the holding piece to form an air layer between them; and at least one said external wall board that is held with the holding piece of said wall materials bracket;

wherein:

the air layer between said wall substrate and said inner wall board is sealed to function as an airtight layer;

the air layer between said inner wall board and said external wall board is connected to the open air to function as a vent layer.

10. The wall materials bracket according to claim 1, wherein the inner wall board comprises an insulation.

11. A wall materials bracket for fixing an inner wall board and an external wall board as wall materials on a wall substrate, the wall materials bracket comprising:

a flat-shaped base piece that is configured to be fixed on an outer surface of the wall substrate;

a flat-shaped catching piece that is configured to protrude outward from between upper and lower parts of said base piece, said catching piece configured to hold a bottom or a top end of at least one inner wall board to restrict downward or upward movement of the at least one inner wall board;

a spacing piece that is configured to be interposed between the at least one inner wall board and at least one external wall board to form an air layer between them, said spacing piece being formed at a tip of said catching piece so as to face the upper and lower parts of said base piece, said spacing piece configured to sandwich the at least one inner wall board between the base piece and the spacing piece; and a holding piece that is formed outside of said spacing piece, said holding piece configured to hold the at least one external wall board to restrict outward and inward movement, as well as downward or upward movement of the at least one external wall board, wherein the holding piece is formed outside of said spacing piece and comprises upper and lower holding parts respectively protruding upward and downward from a position lower than the tip end of said catching piece.

12. The wall materials bracket according to claim 11, wherein the inner wall board comprises an insulation.

13. The wall materials bracket according to claim 11, wherein the spacing piece comprises front and rear pieces, and wherein the holding piece is formed outside the front piece of said spacing piece.

14. The wall materials bracket according to claim 11, wherein the catching piece is provided perpendicular to the base piece.

* * * * *

UNITED STATES PATENT AND TRADEMARK OFFICE

CERTIFICATE OF CORRECTION

PATENT NO. : 7,849,651 B2
APPLICATION NO. : 11/407911
DATED : December 14, 2010
INVENTOR(S) : M. Fujito et al.

It is certified that error appears in the above-identified patent and that said Letters Patent is hereby corrected as shown below:

On cover page, Assignee (73), please change "Kubota Matsushitadenko Exterior Works, Ltd." To --KMEW Co., Ltd.--.

On cover page, References Cited (56), Foreign Patent Documents, Page 2, (Column 2, line 13), please delete "JP 2003-074132".

Signed and Sealed this
Ninth Day of August, 2011

David J. Kappos

David J. Kappos
*Director of the United States Patent and Trademark Office*